United States Patent [19]

McEwen et al.

[11] Patent Number: 4,874,091

[45] Date of Patent: Oct. 17, 1989

[54] CORE SAMPLE BOX

[76] Inventors: Albert R. McEwen, 303-10124-159th Street, Edmonton, Alberta, Canada T5P 2F9; William J. Forrest, 15-9510 Morinville Drive, Morinville, Alberta, Canada T0G 1P0

[21] Appl. No.: 218,955

[22] Filed: Jul. 14, 1988

[51] Int. Cl.[4] ..... B65D 85/20

[52] U.S. Cl. ..... 206/443; 220/22

[58] Field of Search ..... 206/443, 446; 220/20, 220/21, 22

[56] References Cited

U.S. PATENT DOCUMENTS

| | | | |
|---|---|---|---|
| 1,217,283 | 2/1917 | Daniel et al. | 206/443 |
| 2,013,051 | 9/1935 | Hermani | 220/22 |
| 3,272,329 | 9/1966 | Mehalov | 206/443 |
| 3,581,929 | 6/1971 | Guenard et al. | 206/443 |
| 3,590,752 | 7/1971 | De Pew | 206/443 |
| 3,786,932 | 1/1974 | Smith | 206/443 |

FOREIGN PATENT DOCUMENTS

| | | | |
|---|---|---|---|
| 532244 | 10/1936 | Canada . | |
| 531345 | 10/1956 | Canada . | |
| 896357 | 3/1972 | Canada . | |
| 972302 | 8/1975 | Canada | 206/443 |
| 701985 | 1/1985 | Canada . | |

*Primary Examiner*—Stephen Marcus
*Assistant Examiner*—Jacob Ackun
*Attorney, Agent, or Firm*—Adrian D. Battison; Stanley G. Ade; Adrian D. Battison

[57] ABSTRACT

A core sample box for diamond drilled core samples is integrally molded from a plastics material to form an inner core engaging layer and an outer layer adjacent thereto but separated therefrom. The inner layer defines a plurality of part cylindrical receptacles for receiving the cylindrical cores. The outer layer is spaced from the outer surface of the core engaging layer so that the two layers together forms sufficient rigidity to hold the device against twisting. Further rigidity is provided by connection points between the outer layer and the base of the receptacles molded into the outer layer.

17 Claims, 2 Drawing Sheets

CORE SAMPLE BOX

BACKGROUND OF THE INVENTION

This invention relates to a container or box for storing core samples of the type which are generated during survey drilling procedures otherwise known as diamond drilling.

Core sample boxes have been manufactured for many years and are generally formed from wooden sheets which are nailed together to form a backing sheet and upstanding walls thus defining a number of elongate compartments or receptacles within which the core sample is retained. These boxes are then stored in racks so that the whole of the elongate sample drilled into the ground is maintained for a number of years for restudying should a further later survey be required for other purposes.

It has been appreciated for many years that the wooden core sample boxes are very unsatisfactory in that they are difficult to manufacture, do not properly hold the core sample, and provide only limited protection for the sample.

Attempts have been made therefore to design core boxes from alternative materials particularly plastics moldings and examples of these devices are shown in Canadian patent 701,985 (Glass), Canadian patent 532,244 (Genjack), Canadian patent 531,345 (McBean), Canadian patent 896,357 (Smith) and U.S. Pat. No. 3,581,929 (Guenard).

The devices shown in the above prior patents are generally unsatisfactory and have not achieved any commercial success in the marketplace. In many cases the reasons for the failure of the product to be accepted reside in its inability to remain rigid since if the product is not sufficiently rigid it can twist and become impossible to handle or can even open allowing the stored samples to be destroyed.

Many attempts have been made to manufacture products of this type by extrusion or by molding of a corrugated sheet which stores the samples on an upper surface of the sheet. However such materials have been found to have insufficient rigidity.

SUMMARY OF THE INVENTION

It is one object of the present invention, therefore, to provide a core box of this general type which is manufactured by molding from a plastics material which obtains by the structure sufficient rigidity to support the core samples and to allow the box to be lifted with the samples in without danger of twisting or loss of the samples.

According to the invention, therefore, there is provided a container for drill core samples comprising an integrally molded body defining a core engaging layer and an outer layer, said core engaging layer having two elongate longitudinal side edges and two transverse end edges and between said side edges a plurality of elongate parallel receptacles arranged side by side each for receiving a length of core sample and each having a surface against which the sample engages shaped to confine the sample against vertical movement toward the layer and against side to side movement, said outer layer being connected to said core engaging layer at said side edges and at said transverse end edges and being spaced therefrom to define a hollow interior of the body therebetween.

According to a second aspect of the invention there is provided a container for drill core samples comprising an integrally molded body defining a core engaging layer and an outer layer, said core engaging layer having two elongate longitudinal side edges and two transverse end edges and between said side edges a plurality of elongate parallel receptacles arranged side by side each for receiving a length of core sample and each having a curved base surface shaped to support the sample and upstanding side walls shaped to confine the sample against side to side movement, said outer layer being substantially flat and connected to said core engaging layer at said side edges and at said transverse end edges so as to be substantially coextensive with said core engaging layer, said layers being of substantially constant thickness and thin relative to the thickness of the body, said outer layer and said core engaging layer having sufficient rigidity such that the layers are self-supporting to maintain the outer layer spaced from said core engaging layer over substantially the full extent of said outer layer from one side edge to the opposed side edge and full one end edge to the opposed end edge, said outer layer including a plurality of separate spaced molded indentations therein engaging said the core engaging layer such that the outer layer is connected to the core engaging layer at each of said indentations.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
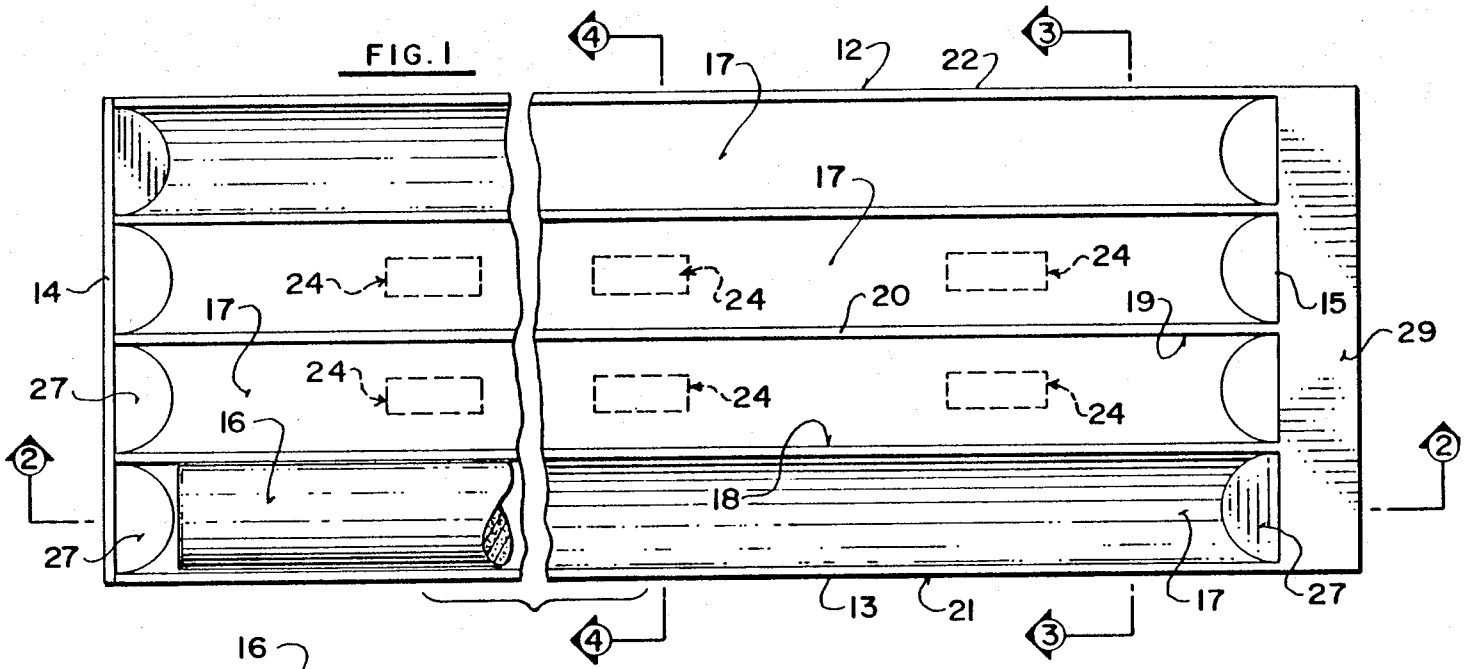
FIG. 1 is a top plan view of a core sample box according to the invention.
Figure 2:
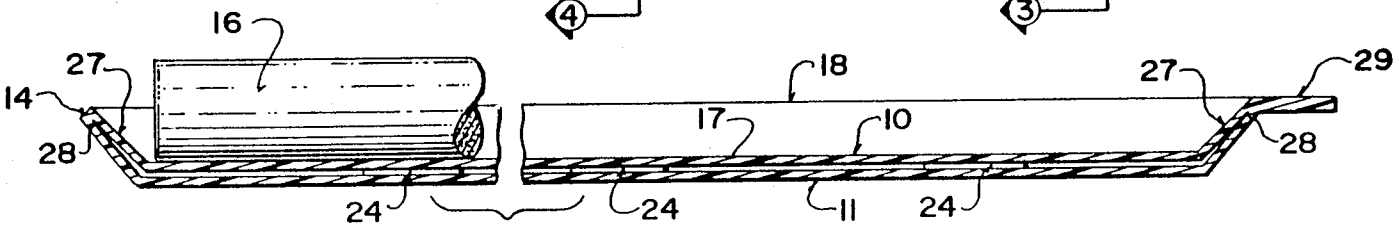
FIG. 2 is a cross sectional view along the lines 2—2 of FIG. 1.

The core sample box shown in FIGS. 1 through 4 comprises an integral molded body formed by rotational molding from a suitable plastics material. The rotational molding technique generates a closed hollow body formed from an inner core engaging layer 10 and an outer layer 11. As shown in FIG. 1, the body is rectangular in shape defining side edges 12 and 13 which are elongate and parallel together with end edges 14 and 15 which are also parallel. The inner core engaging layer and the outer layer are substantially coextensive being joined at the side edges and at the end edges.

Figure 3:
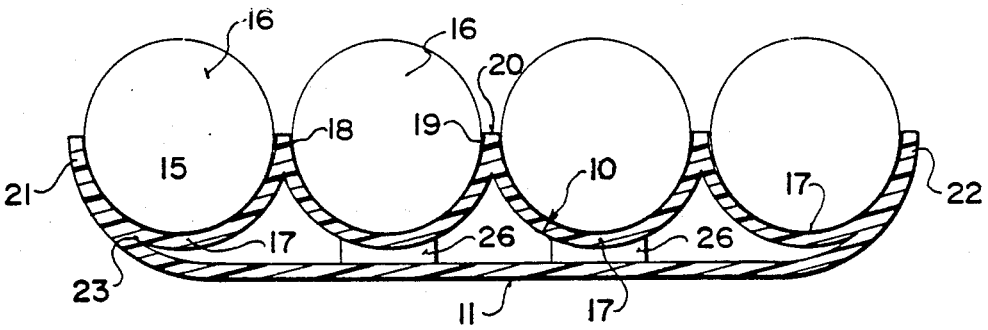
FIG. 3 is a cross sectional view along the lines 3—3 of FIG. 1.

The core engaging layer 10 is shaped as best shown in FIG. 3 to form a plurality of receptacles 15 for cylindrical core samples 16. Each of the receptacles forms a half cylinder of circular cross section thus defining for each receptacle a base portion 17 which vertically supports the core sample 16 together with side walls 18 and 19 which prevent the core sample from moving laterally. The radius of curvature of the inner surface is arranged to closely follow the intended radius of the core sample so that it is closely retained within the inner surface. The side walls 18 of one receptacle join directly to the side wall of the next adjacent receptacle so as to form an apex 20 therebetween. In this way the receptacles lie directly side by side with minimum material therebetween.

At the side edges of the outermost receptacles indicated at 21 and 22, the outer layer 11 joins contiguously with the side wall such that the side wall at the side edge forms effectively both the side wall itself and the portion of the outer layer. Further strengthening of the structure can be achieved by further separating the outer layer and the inner core engaging layer so that the point of joining indicated at 23 is moved further out along the side edge thus forming the two separate layers over a greater extent.

The manufacture of the device from the two separate layers provides significantly increased strength so that the completed body is resistant to twisting about axes generally longitudinal to the device.

Figure 4:
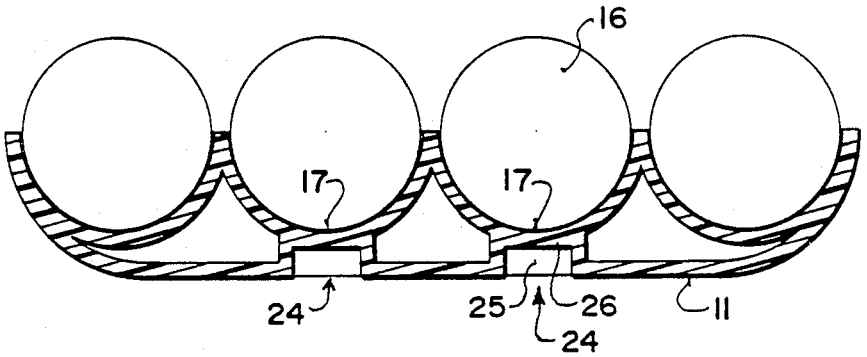
FIG. 4 is a cross sectional view along the lines 4—4 of FIG. 1.

To yet further increase the resistance to twisting and to increase the rigidity, spaced separate interconnections between the outer layer and the core engaging layer are formed at the points indicated in FIG. 1 at 24. These connections are provided between the base portion 17 of a receptacle and the adjacent portion of the outer layer. The connections are shown in FIG. 4. The connections are formed by molding into the outer layer a recess 25 so that the outer layer is diverted inwardly to an extent so that it contacts during molding the outer surface of the base portion 17 so that the outer layer and the base portion 17 become integral at that point as indicated in FIG. 4 at 26. Each of these connection points is of limited width so that it is restricted to an narrow area of the receptacle. It is also of limited length generally of the order of one to two inches so that the outer layer and the base portion of the receptacle remain separated basically along their full length apart from the separate spaced connection points 24. In one example in which the receptacle is of the order of five feet in length, there may be three such connection points equidistantly spaced along the receptacle.

As shown in FIG. 1, the connection points 24 are provided only in the center two receptacles and are not included in the outer receptacles in view of the close connection between the outer layer and the core engaging layer at that point. In other arrangements particularly where there is an increased separation between the outer layer and the core engaging layer at the side edges, the connection points 24 may be included also in the outermost receptacles. In this case there may be a reduced number of connection points in the inner receptacles or there may be no such connections points on the inner receptacles depending upon the strength requirements.

Although there are shown four such receptacles, of course this number may be varied in dependence upon requirements.

At the ends of each receptacle, the endmost surfaces incline as indicated at 27 upwardly toward the end edge 14, 15. The space between the outer layer and the core engaging layer at the inclined portion 27 gradually tapers to zero at a position closely adjacent the side edge as indicated at 28. On the end edge 15, both the inner and outer layers are united and are molded to form a flange 29 which extends outwardly from the edge 15 in a horizontal plane that is parallel to the outer layer 11. The flange 29 is arranged for receiving information concerning the core samples stored by way of labels or directly written information as required.

During transportation of a core sample, the container can cooperate with an identical container inverted over the top of the container so that the receptacles form a complete cylinder surrounding the core sample.

Figure 5:
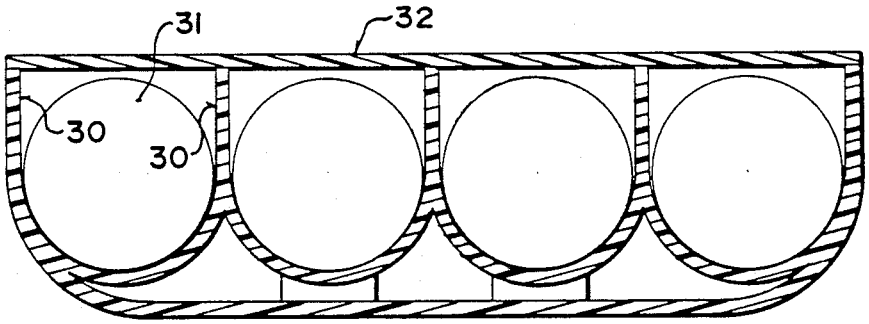
FIG. 5 is a cross sectional view similar to that of FIG. 3 showing an alternative form of the core sample box for use with cores which are less integrated.

In FIG. 5 is shown an alternative arrangement of substantially identical construction to that of FIGS. 1 through 4. The only difference is that the side walls of the receptacles as indicated at 30 are increased in height to a height approximating the diameter of the intended core sample indicated at 31 so that the whole of the receptacle is sufficient to receive a core sample and to fully confine that core sample. The box construction as shown in FIG. 5 is used in cases where the core sample is less solid and hence prone to collapse from the cylindrical shape into merely a layer of the material at the base of the receptacle. In such a case the box construction of FIGS. 1 through 4 would be unsatisfactory since the layers would tend to spill with some material being lost and some material mixing with the other layers in the other receptacles. In this case the side walls of increased height can cooperate with a simple flat plate 32 to form an enclosure for the core sample. For transportation, the two cooperating box constructions of FIG. 4 or the construction shown in FIG. 5 can be maintained in position simply by wrapping by suitable material such as wire. When the transportation is complete and the core sample is intended for simple storage, the upper layer formed either by the flat plate 32 or by the inverted sample box can be removed and returned for further use.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A container for drill core samples comprising an integrally molded body defining a core engaging layer and an outer layer, said core engaging layer having two elongate longitudinal side edges and two transverse end edges and between said side edges a plurality of elongate parallel receptacles arranged side by side each for receiving a length of core sample and each having a surface against which the sample engages shaped to confine the sample against vertical movement toward the layer and against side to side movement, said outer layer being connected to said core engaging layer at said side edges and at said transverse end edges and being spaced therefrom to define a hollow interior of the body therebetween and including a plurality of separate, spaced, molded indented portions thereof each engaging and connecting with a separate portion of said core engaging layer.

2. The invention according to claim 1 wherein said outer layer and said core engaging layer have sufficient rigidity such that the layers are self-supporting to maintain the outer layer spaced from said core engaging layer over substantially the full extent of said outer layer from one side edge to the opposed side edge and from one end edge to the opposed end edge, said outer layer including a plurality of separate spaced portions thereof molded to engage the core engaging layer such that the outer layer is connected to the core engaging layer at each of said portions.

3. The invention according to claim 1 wherein each of the receptacles has an elongate base portion of the core engaging layer arranged closest to the outer layer and two side portions each on a respective side of the base portion for confining the sample against side to side movement, said outer layer being connected to said base portion of at least one of the receptacles at a plurality of separate spaced locations therealong.

4. The invention according to claim 1 wherein said surface of each of said receptacles has a semi-circular portion in cross section.

5. The invention according to claim 1 wherein each of said receptacles includes a base portion of said surface closest to said outer layer and side portions upstanding therefrom on respective sides thereof for confining said sample against side to side movement, a side portion of each receptacle being directly joined to a side portion of the next adjacent receptacle thus forming an apex at said joined side portions.

6. The invention according to claim 5 wherein said outer layer at said side edges joins directly with an outer portion of outer ones of said receptacles at said side edges such that the outer surface and the outer portion are contiguous at said side edge and form an apex at said side edge.

7. The invention according to claim 1 wherein a base of each of said receptacles in a direction longitudinal of the receptacle is straight and endmost portions thereof are inclined upwardly from the base to said transverse end edge.

8. The invention according to claim 7 including a flange member extending outwardly from said inclined portion at one of said end edges and lying in a plane parallel to said base portions of said receptacles.

9. The invention according to claim 1 wherein each of the receptacles is semi-circular in cross section and wherein said container is arranged for cooperation with a similar container inverted relative thereto such that the receptacles of the container form with the receptacles of the inverted container a substantially circular cylindrical area for receiving a circular cylindrical core sample.

10. The invention according to claim 1 wherein each of said receptacles in cross section has a curved base portion and upstanding sides with the upstanding sides having a height sufficient to receive a circular cylindrical core having a radius equal to a radius of curvature of the curved base portion such that the receptacle is sufficient to receive the whole of a cylindrical core, the container including a first plate member for engaging over the uppermost edges of the side portions to retain the core within the receptacle.

11. A container for drill core samples comprising an integrally molded body defining a core engaging layer and an outer layer, said core engaging layer having two elongate longitudinal side edges and two transverse end edges and between said side edges a plurality of elongate parallel receptacles arranged side by side each for receiving a length of core sample and each having a curved base surface shaped to support the sample and upstanding side walls shaped to confine the sample against side to side movement, said outer layer being substantially flat and connected to said core engaging layer at said side edges and at said transverse and edges so as to be substantially coextensive with said core engaging layer, said layers being of substantially constant thickness and thin relative to the thickness of the body, said outer layer and said core engaging layer having sufficient rigidity such that the layers are self-supporting to maintain the outer layer spaced from said core engaging layer over substantially the full extent of said outer layer from one side edge to the opposed side edge and from one end edge to the opposed end edge, said outer layer including a plurality of separate spaced molded indentations therein engaging said the core engaging layer such that the outer layer is connected to the core engaging layer at each of said indentations.

12. The invention according to claim 11 wherein a side wall of each receptacle is directly joined to a side wall of the next adjacent receptacle thus forming an apex at said joined side walls.

13. The invention according to claim 12 wherein said outer layer at said side edges joins directly with a side wall of outer ones of said receptacles at said side edges such that the outer surface and the outer side walls are contiguous at said side edge and form an apex at said side edge.

14. The invention according to claim 11 wherein a base of each of said receptacles in a direction longitudinal of the receptacle is straight and endmost portions thereof are inclined upwardly from the base to said transverse end edge.

15. The invention according to claim 14 including a flange member extending outwardly from said inclined portion at one of said end edges and lying in a plane parallel to said base portions of said receptacles.

16. The invention according to claim 11 wherein each of the receptacles is semi-circular in cross section and wherein said container is arranged for cooperation with a similar container inverted relative thereto such that the receptacles of the container form with the receptacles of the inverted container a substantially circular cylindrical area for receiving a circular cylindrical core sample.

17. The invention according to claim 11 wherein the upstanding side walls have a height sufficient to receive a circular cylindrical core having a radius equal to a radius of curvature of the curved base portion such that the receptacle is sufficient to receive the whole of a cylindrical core, the container including a flat plate member for engaging over the uppermost edges of the side portions to retain the core within the receptacle.

* * * * *